US008313103B2

(12) United States Patent
O'Neal et al.

(10) Patent No.: US 8,313,103 B2
(45) Date of Patent: Nov. 20, 2012

(54) PORTABLE PROJECTILE TRAP ASSEMBLY

(76) Inventors: Kerry O'Neal, Eagle, ID (US); Noreen Powers, Johns Island, SC (US)

( * ) Notice: Subject to any disclaimer, the term of this patent is extended or adjusted under 35 U.S.C. 154(b) by 239 days.

(21) Appl. No.: 12/730,052

(22) Filed: Mar. 23, 2010

(65) Prior Publication Data

US 2011/0037227 A1 Feb. 17, 2011

Related U.S. Application Data

(60) Provisional application No. 61/233,753, filed on Aug. 13, 2009.

(51) Int. Cl.
*F41J 13/00* (2009.01)

(52) U.S. Cl. ..... 273/410; 273/407; 273/404

(58) Field of Classification Search ..... 273/403–410
See application file for complete search history.

(56) References Cited

U.S. PATENT DOCUMENTS

| | | | | | |
|---|---|---|---|---|---|
| 2,535,280 | A * | 12/1950 | Gartrell | 273/404 |
| 3,404,887 | A * | 10/1968 | Dundr | 273/410 |
| 4,512,585 | A * | 4/1985 | Baravaglio | 273/410 |
| 4,773,653 | A * | 9/1988 | Unverzagt | 273/404 |
| 4,819,946 | A * | 4/1989 | Kahler | 273/404 |
| 4,821,620 | A * | 4/1989 | Cartee et al. | 273/410 |
| 4,856,791 | A * | 8/1989 | McQuade | 273/410 |
| 5,040,802 | A * | 8/1991 | Wojcinski et al. | 273/410 |
| 5,366,105 | A * | 11/1994 | Kerman et al. | 220/62.11 |
| 5,564,712 | A * | 10/1996 | Werner | 273/410 |
| 5,607,163 | A * | 3/1997 | Nesler | 273/410 |
| 5,822,936 | A * | 10/1998 | Bateman | 52/281 |
| 5,988,647 | A * | 11/1999 | Porter et al. | 273/410 |
| 6,526,861 | B1 * | 3/2003 | Gruber | 273/410 |
| 6,530,572 | B1 * | 3/2003 | Overley | 273/410 |
| 6,715,761 | B1 * | 4/2004 | Moberg | 273/410 |
| 7,434,810 | B2 * | 10/2008 | DeMille et al. | 273/404 |
| 7,967,296 | B1 * | 6/2011 | Halverson | 273/410 |
| 2005/0022658 | A1 * | 2/2005 | Bateman et al. | 89/36.01 |
| 2006/0208425 | A1 * | 9/2006 | Lambert et al. | 273/410 |

FOREIGN PATENT DOCUMENTS

| | | | |
|---|---|---|---|
| DE | 3734439 | A1 * | 4/1989 |
| EP | 332273 | A1 * | 9/1989 |

* cited by examiner

*Primary Examiner* — Mark Graham
(74) *Attorney, Agent, or Firm* — Parsons Behle & Latimer

(57) ABSTRACT

A portable projectile trap assembly includes a modular target assembly having a frame configured to retain a plurality of backstop panels. The plurality of backstop panels are removably mounted on a front side of the frame forming a planar backstop, and a front panel of resilient material is removably mounted to and covers the front side of the planar backstop opposite the frame. The front panel is spaced from the planar backstop to form an air gap between the backstop and the front panel. When a projectile is fired at the target assembly, the projectile passes through the front panel and impacts against and is stopped by the backstop. The target assembly is attached to a support mast at the rear side of the frame; the support mast is attached to a mobile base supporting the target assembly in a vertical orientation above the mobile base.

21 Claims, 7 Drawing Sheets

PORTABLE PROJECTILE TRAP ASSEMBLY

CROSS REFERENCE TO RELATED APPLICATIONS

This application claims priority of U.S. provisional patent application Ser. No. 61/233,753 filed Aug. 13, 2009 entitled "Portable Bullet Trap" and hereby incorporated by reference.

BACKGROUND

The present application relates generally to shooting range safety devices and, more specifically, to a portable projectile trap assembly to stop and contain projectiles fired at the assembly.

Bullet traps per se are well-known and have been used for many years. Typically, such traps are used by firearm manufacturers, by training facilities for military or police personnel, and by recreational target shooting facilities. Bullet traps are of widely varying configurations, from wood boards, to sand-filled traps, to complex deceleration chambers.

By way of example, a known sand-type bullet trap typically consists of a quantity of sand in a hardwood box set against a concrete wall. This type of trap poses several problems. For example, as the trap begins to fill with lead bullets, there is a risk that an incoming bullet will strike a bullet lodged in the sand and ricochet in a dangerous manner.

More recently, bullet traps have been developed which are smaller and portable, and which contain and collect the spent bullets. For example, one such bullet trap is essentially a steel box having a removable plywood front. Bullets fired at the trap pass through the plywood, shatter on the steel back of the box and fall to the floor of the box. When the plywood front becomes too full of bullet holes to safely contain the shattered bullets, the plywood is removed, the shattered bullets at the bottom of the box are collected, and the plywood front is replaced with a new piece of plywood. Other designs are similar but use a front panel of a rubberized material, sometimes referred to as ballistic rubber, rather than plywood to contain the shattered bullets. In other similar designs, the box will not have a bottom panel and is left open at the bottom. A tray or similar device is placed under the open bottom of the box to collect the shattered bullets.

SUMMARY

The present application discloses a portable projectile trap assembly to stop projectiles, such as bullets, for example, and collect the spent projectiles. In a first embodiment, a portable projectile trap assembly includes a frame configured to retain a plurality of backstop panels, a plurality of backstop panels mounted in the frame to form a planar backstop, and a panel of resilient material covering the planar backstop, the panel of resilient material being spaced from the planar backstop. The frame is bolted or otherwise attached to a support mast which is attached to a mobile base which allows the projectile trap to be moved from one position to another.

In a second embodiment, a portable projectile trap assembly includes a modular target assembly including a frame configured to retain a plurality of backstop panels, the plurality of backstop panels removably mounted on a front side of the frame forming a planar backstop. The assembly further comprises a panel of resilient material removably mounted to and covering the side of the planar backstop opposite the frame, the panel of resilient material being spaced from the planar backstop, and the target assembly disposed in a vertical orientation and attached at a rear side of the frame to a mobile base.

The modular target assembly includes a top mounting rail and a bottom mounting rail fixedly attached to the top and bottom edges, respectively, of the frame. Each of the top and bottom mounting rails includes a track running the length of the mounting rail and a channel spaced from and parallel to the track. The frame comprises a plurality of spaced intermediate mounting rails positioned between and parallel to the top and the bottom mounting rails, each of the intermediate mounting rails having a track formed on each side of the rail at an edge of the rail opposite the frame, and the track running the length of the rail. The tracks formed on the top and the bottom mounting rails and on the spaced intermediate rails are aligned with one another. Each of the backstop panels includes a groove formed in each of two opposing edges of the backstop panel for slideably engaging a mounting rail track. The backstop panels are slideably mounted on the tracks and retained between the spaced intermediate mounting rails and the top and bottom mounting rails. The bottom mounting rail includes an open gap running the length of the bottom rail formed between the track and the channel of the bottom mounting rail.

In another embodiment, a portable projectile trap assembly includes a generally rectangular modular target assembly having at least two first mounting brackets attached to a rear side of the target assembly along a centerline parallel to the long dimension of the target assembly and at least two second mounting brackets attached to the rear side of the target assembly along a centerline parallel to the short dimension of the target assembly. The first mounting brackets removably attach the target assembly to a support mast along the long dimension of the target assembly. The second mounting brackets removably attach the target assembly to the support mast along the short dimension of the target assembly. The support mast is attached to the mobile base allowing the target assembly to be supported in a vertical orientation at two different heights above the mobile base.

BRIEF DESCRIPTION OF THE DRAWINGS

The following figures, in which like numerals indicate elements, form part of the present specification and are included to further demonstrate certain aspects of the present disclosure. The disclosure may be better understood by reference to one or more of these figures in combination with the detailed written description of specific embodiments presented herein.

These and other embodiments of the present application will be discussed more fully in the description. The features, functions, and advantages can be achieved independently in various embodiments of the claimed invention, or may be combined in yet other embodiments.

DETAILED DESCRIPTION

One or more illustrative embodiments are described below. Not all features of an actual implementation are necessarily described or shown for the sake of clarity.

Figure 2:
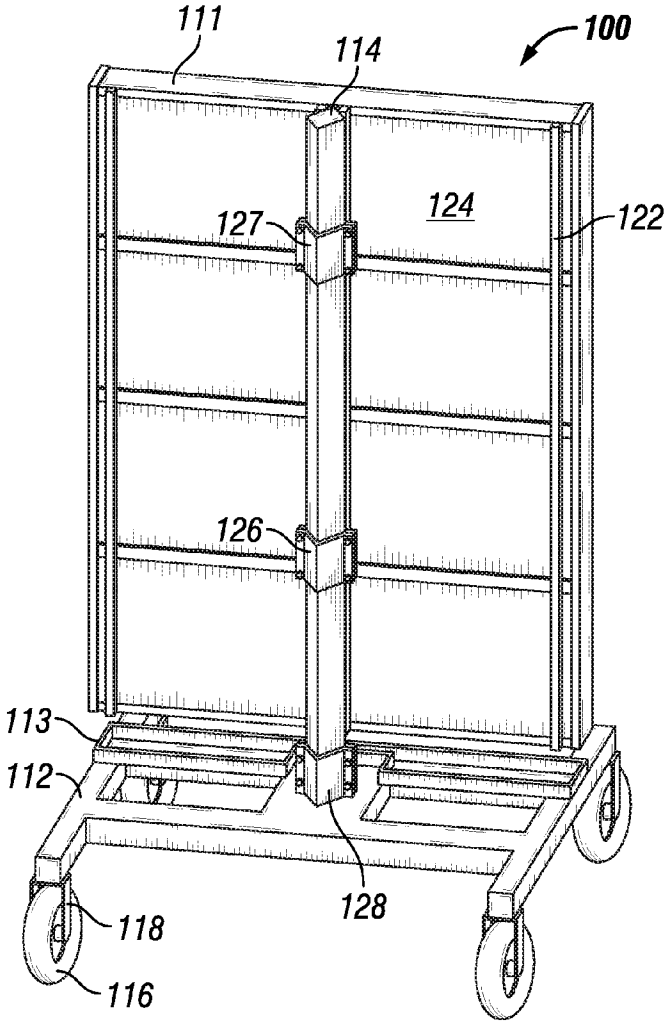
FIG. 2 is a perspective view from the rear of the portable projectile trap assembly shown in FIG. 1.
Figure 1:
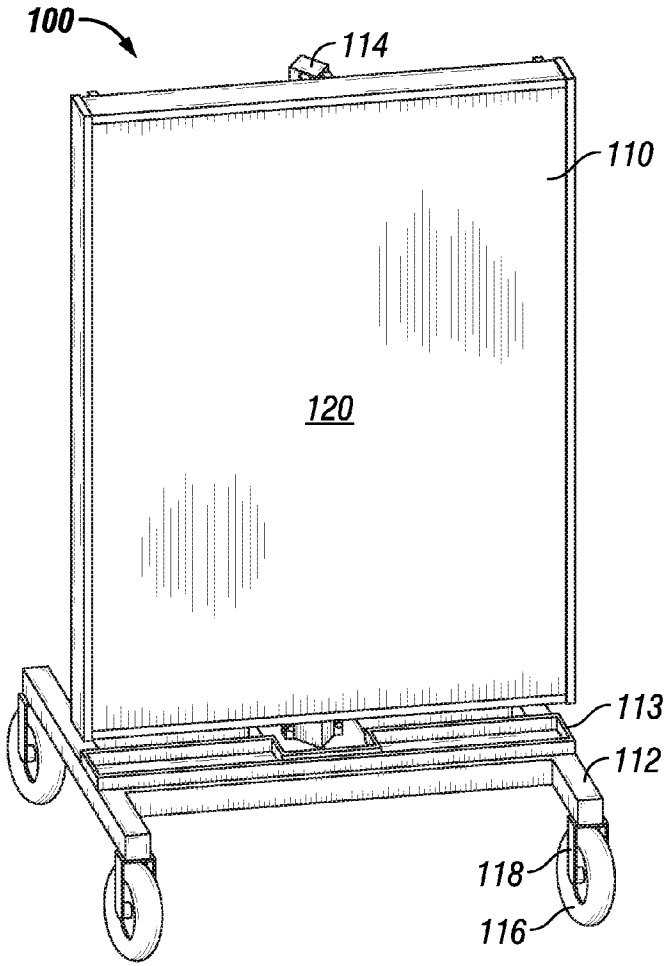
FIG. 1 is a perspective view from the front of an embodiment of a portable projectile trap assembly disclosed in the present application.

Referring now to FIGS. 1 and 2, FIG. 1 is a perspective view from the front of an embodiment of a portable projectile trap assembly 100 disclosed in the present application. The projectile trap assembly is modular rather than a single unit. The modular nature of the projectile trap assembly 100 allows the parts to be shipped to a site and then assembled for use. The projectile trap assembly 100 at a first site may also be disassembled for shipment and reassembled at a different site. The target assembly 110 is mounted to a movable base 112 by a support mast 114. A number of wheels 116, pneumatic wheels, for example, are mounted to the base 112 via swivel mounts 118 allowing the base 112 and the attached target assembly 110 to be easily moved or rolled from one location to another. FIG. 2 is a perspective view from the back of the portable projectile trap assembly 100 illustrating the frame 122 and the supporting mast 114. The target assembly 110 includes a frame 122 and a number of backstop panels 124. A front panel 120 of resilient material is attached to and covers the front side of the target assembly 110. The target assembly 110 is supported in a vertical position by support mast 114. The support mast 114 is removably attached to the base 112 by base bracket 128. The frame 122 is removably attached to support mast 114 by lower and upper brackets 126, 127.

Figure 4:
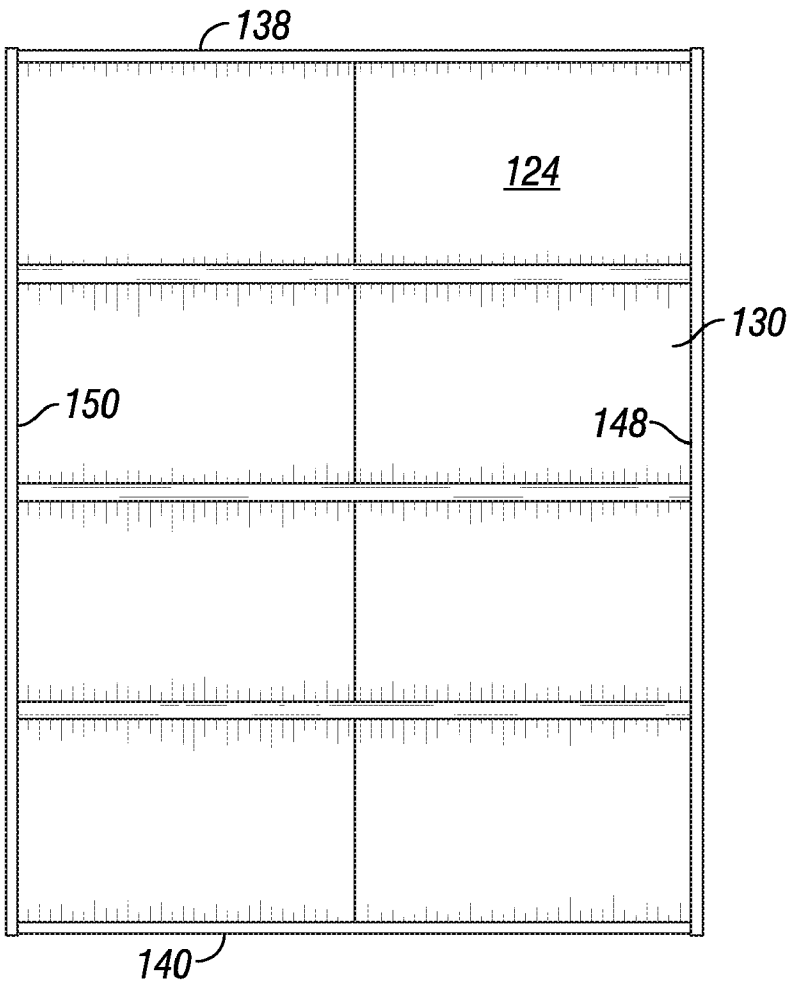
FIG. 4 is a front view of the frame shown in FIG. 3 with the backstop panels installed forming the backstop plate.
Figure 8:
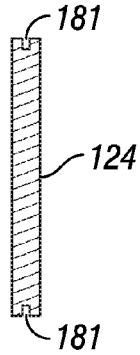
FIG. 8 is a side view of a backstop panel of the portable projectile trap assembly shown in FIG. 1.
Figure 9:
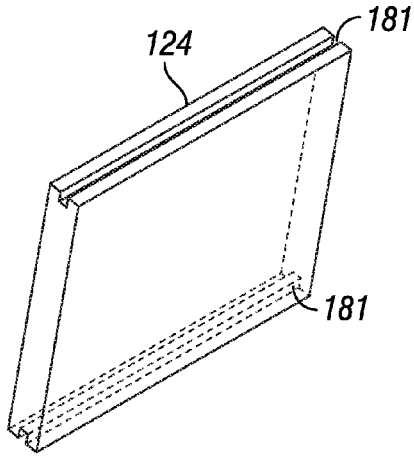
FIG. 9 is a perspective view of the backstop panel shown in FIG. 8.

The backstop panels 124 are mounted in and retained by the frame 122 forming a modular planar surface 130, as shown in FIG. 4, or flat plate at the front side of the frame 122. The backstop panels 124, also shown in FIGS. 8 and 9, are of a suitable material, such as abrasion resistant steel plate, for example, for stopping and absorbing the energy of a projectile, such as a bullet, for example, fired at the target assembly 110. A removable panel 120 of resilient material, such as styrene butedyne rubber or recycled, vulcanized tire rubber (sometimes referred to as ballistic rubber), for example, attached to the front side of the target assembly 110 covers the planar surface 130 formed by the backstop panels 124 and is separated from the planar surface 130 by a short distance, one inch, for example.

Figure 3:
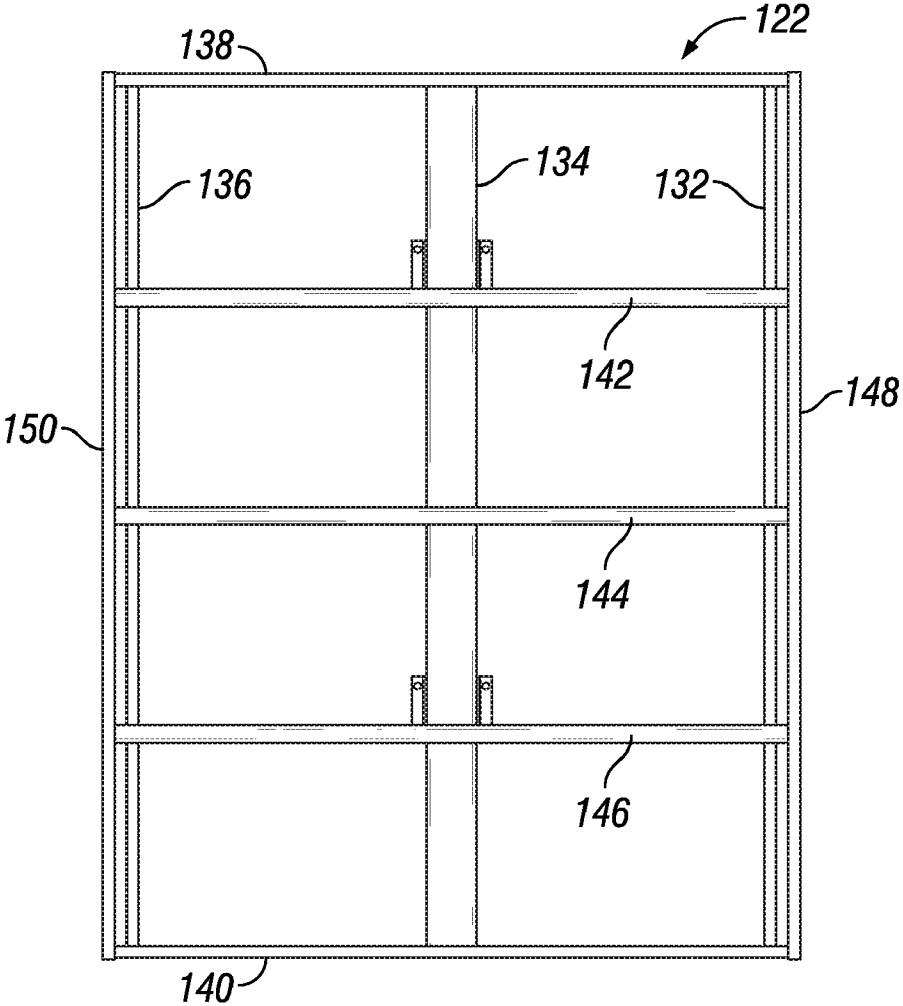
FIG. 3 is a front view of the frame for the portable projectile trap assembly shown in FIG. 1.
Figure 10:
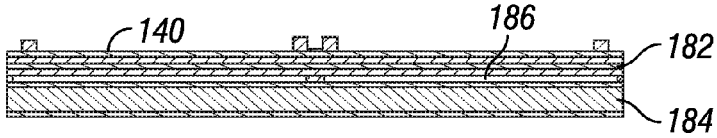
FIG. 10 is a top view of a bottom rail of the projectile trap assembly frame shown in FIG. 8.

A target or targets (not shown) can then be attached to the front or outside surface of the resilient panel 120. When a projectile is fired at the target, the projectile passes through the target and resilient panel 120 and impacts against and is stopped by the backstop panels 124. The projectile's velocity is reduced substantially by its passage through the resilient panel 120 while the remaining energy is absorbed by the projectile's impact against the surface 130. Projectile fragments and other debris, such as lead dust, for example, are contained within the air space between the surface 130 and the front panel 120. The projectile fragments and other debris drop through an open gap 186 formed in the bottom rail 140, as shown in FIGS. 3 and 10, into a tray 113 for collection and disposal. In the event the resilient panel 120 becomes damaged due to bullets or other projectiles repeatably passing through the panel 120, it can be easily replaced.

Referring now also to FIGS. 3 and 4, a front view of the frame 122 for the portable projectile trap assembly 100 shown in FIG. 1 is shown. The frame 122 is generally square or rectangular in shape having a number of parallel support members 132, 134, 136 with top and bottom rails 138, 140 fastened across the top and bottom, respectively, on a front side of and perpendicular to the support members 132, 134, 136. Intermediate rails 142, 144, 146 are spaced between the top and bottom rails 138, 140, positioned perpendicularly to and fastened to support members 132, 134, 136 on a front side of the support members 132, 134, 136. The top and bottom rails 138, 140 and the intermediate rails 142, 144, 146 are preferably welded to the support members 132, 134, 136, but may be attached to the support members 132, 134, 136 in any suitable manner to provide a rigid frame 122.

Figure 7:
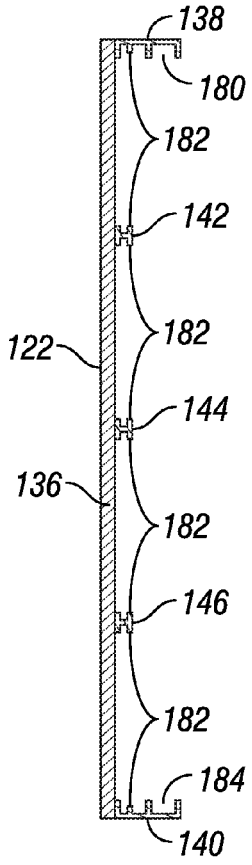
FIG. 7 is a side view of the portable projectile trap assembly frame shown in FIG. 2.

When fully assembled, a number of backstop panels 124 are retained by and between the top and bottom rails 138, 140 and the intermediate rails 142, 144, 146 forming a modular planar surface 130 which constitutes a backstop to stop and absorb the energy of bullets or other projectiles fired at the target assembly 110. End caps 148 and 150 are attached to the frame 122 at each side of the planar surface 130 to tightly retain the backstop panels 124 in place and prevent or minimize separation between the individual backstop panels 124. Preferably, the end caps 148 and 150 are removably attached to the frame 122, such as with bolts and nuts, for example. The backstop panels 124 are made of a suitable material, such as abrasion resistant steel plate, for example, and, preferably, are of substantially identical shape and size and abut adjacent panels when mounted in frame 122 to form a smooth, uninterrupted planar surface 130. However, the backstop panels 124 may be of different sizes and shapes if necessary for a special or custom application. While the embodiment illustrated in FIG. 4 utilizes eight backstop panels 124 to form the planar surface 130, the backstop panels 124 are modular units and any number of backstop panels 124 may be utilized to form a backstop surface of any desired dimensions. The top and bottom rails 138, 140 and the end caps 148, 150 each have a channel, such as channel 180 in top rail 138 as shown in FIG. 7, for example, formed along the edge facing away from the frame 122 for receiving and retaining the resilient panel 120.

Figure 5:
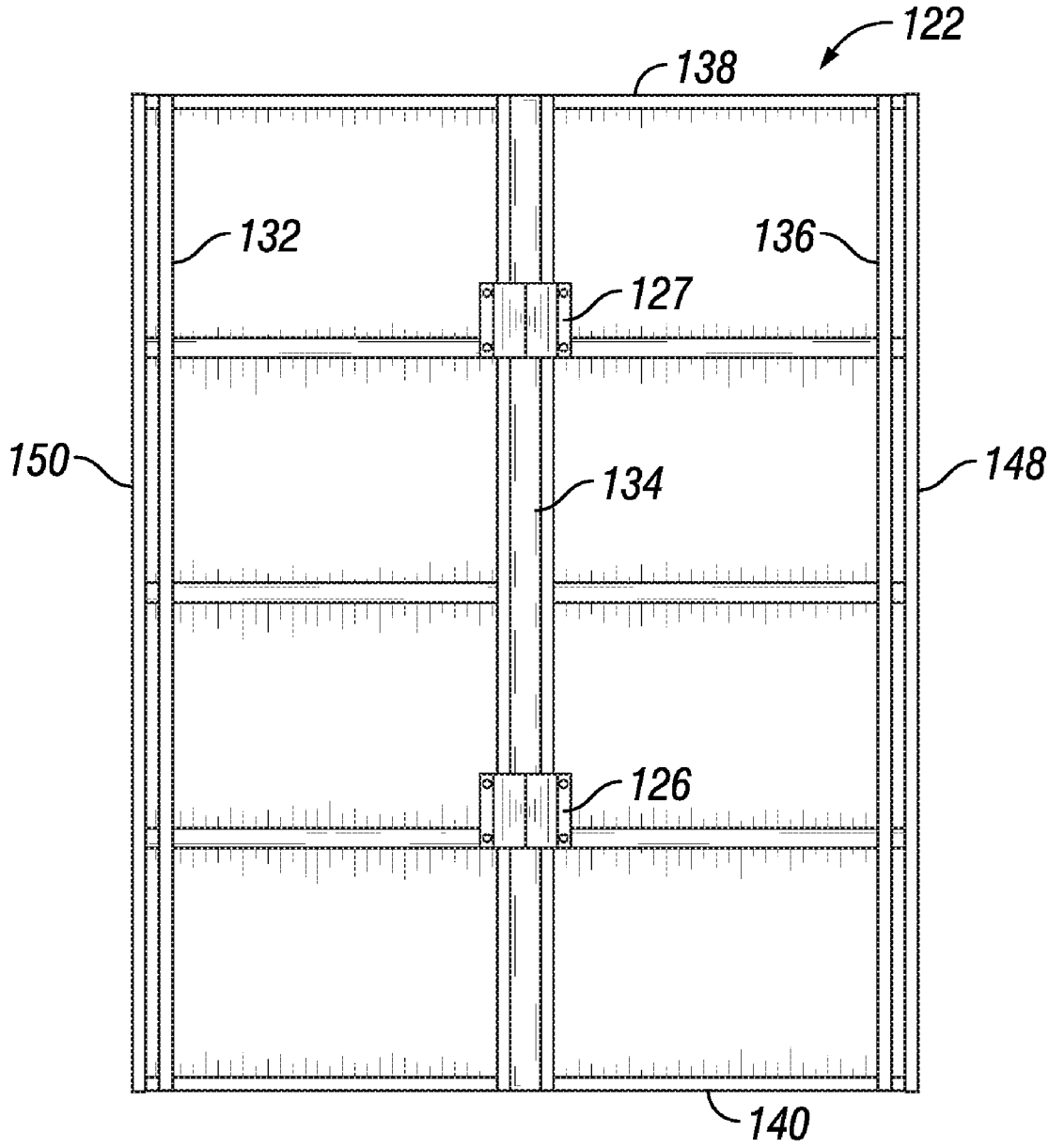
FIG. 5 is a rear view of the frame of the portable projectile trap assembly shown in FIG. 1.

Referring now also to FIG. 5, a rear view of the frame 122 is shown. As described above with reference to FIGS. 3 and 4, the frame 122 is generally square or rectangular in shape having a number of parallel support members 132, 134, 136 with top and bottom rails 138, 140 fastened across the top and bottom, respectively, and a number of intermediate rails 142, 144, 146 fastened on a front side of and perpendicular to the support members 132, 134, 136. A center support member 134 is aligned along a centerline of the frame 122, preferably along the centerline of the longer dimension of the frame 122. The support members 132, 134, 136 are made of a rigid material, such as steel, for example, having sufficient strength to maintain the frame 122 in a rigid shape regardless of the orientation of the frame 122. The center support member 134 is preferably made of heavier material than the two side support members 132 and 136 and has sufficient strength to support the weight of the target assembly 110 when it is held in a vertical orientation. The brackets 126, 127 are spaced apart and fastened, such as by welding or bolting, for example, to the center support member 134. Support mast 114, as shown in FIG. 2, is attached to the frame 122 using brackets 126, 127. The brackets 126, 127 preferably comprise two-piece clamp-type brackets forming an interior shape when held together similar to the exterior shape of the support mast 114. For example, a first half piece of the brackets 126, 127 may be welded to the center support member 134 and the second half piece bolted at its edges to the first half piece clamping the support mast 114 between the two bracket halves and thereby rigidly fastening the support mast 114 to the back of the frame 122. Alternately, for example, a first half piece of the brackets 126, 127 may be welded to the center support member 134 with the first half and the second half of the brackets 126, 127 hinged to each other along one edge, and then bolted together along the other edges to securely clamp the support mast 114 to the back of the frame 122. The brackets 126, 127 are of sufficient weight and strength to securely fasten and hold the support mast 114 to the back of the frame 122. The support mast 114 is made of a material, such as steel, for example, having sufficient rigidity and strength to support the weight of the target assembly 110 when oriented in a vertical position and when being moved on base 112.

Figure 6A:
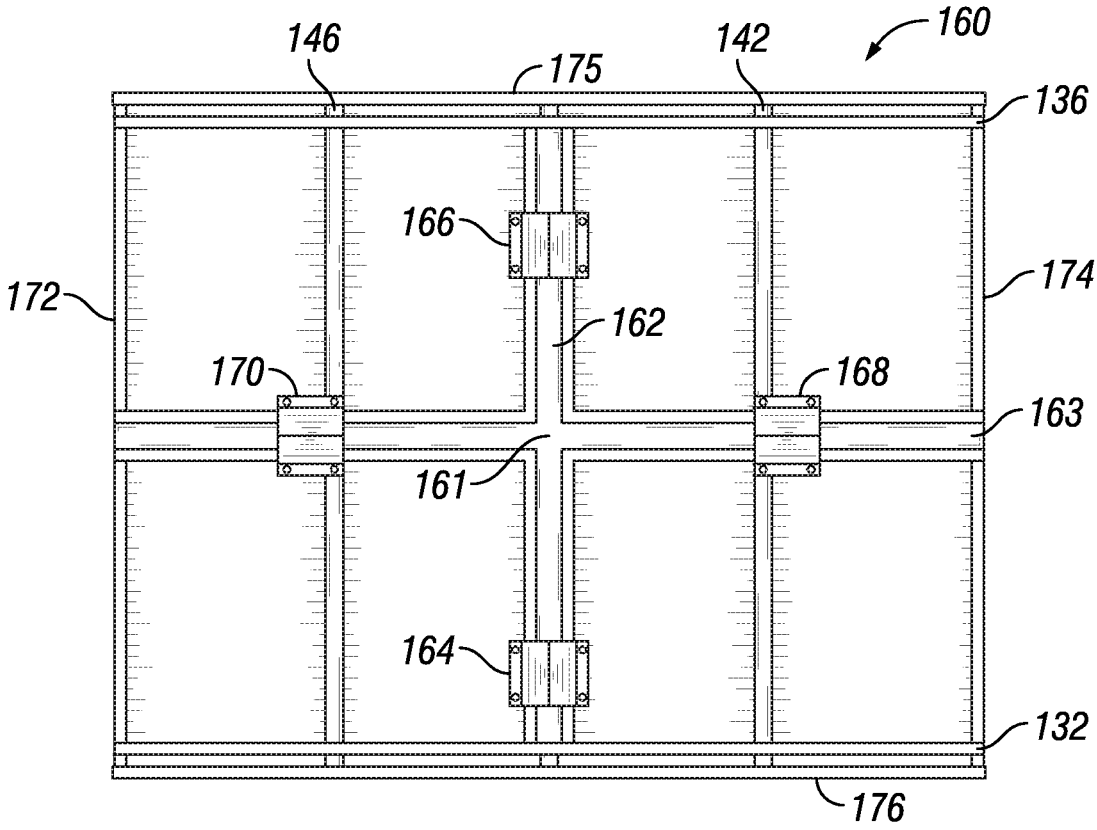
FIGS. 6A and 6B are rear views of another embodiment of the portable projectile trap assembly disclosed in the present application.
Figure 6B:
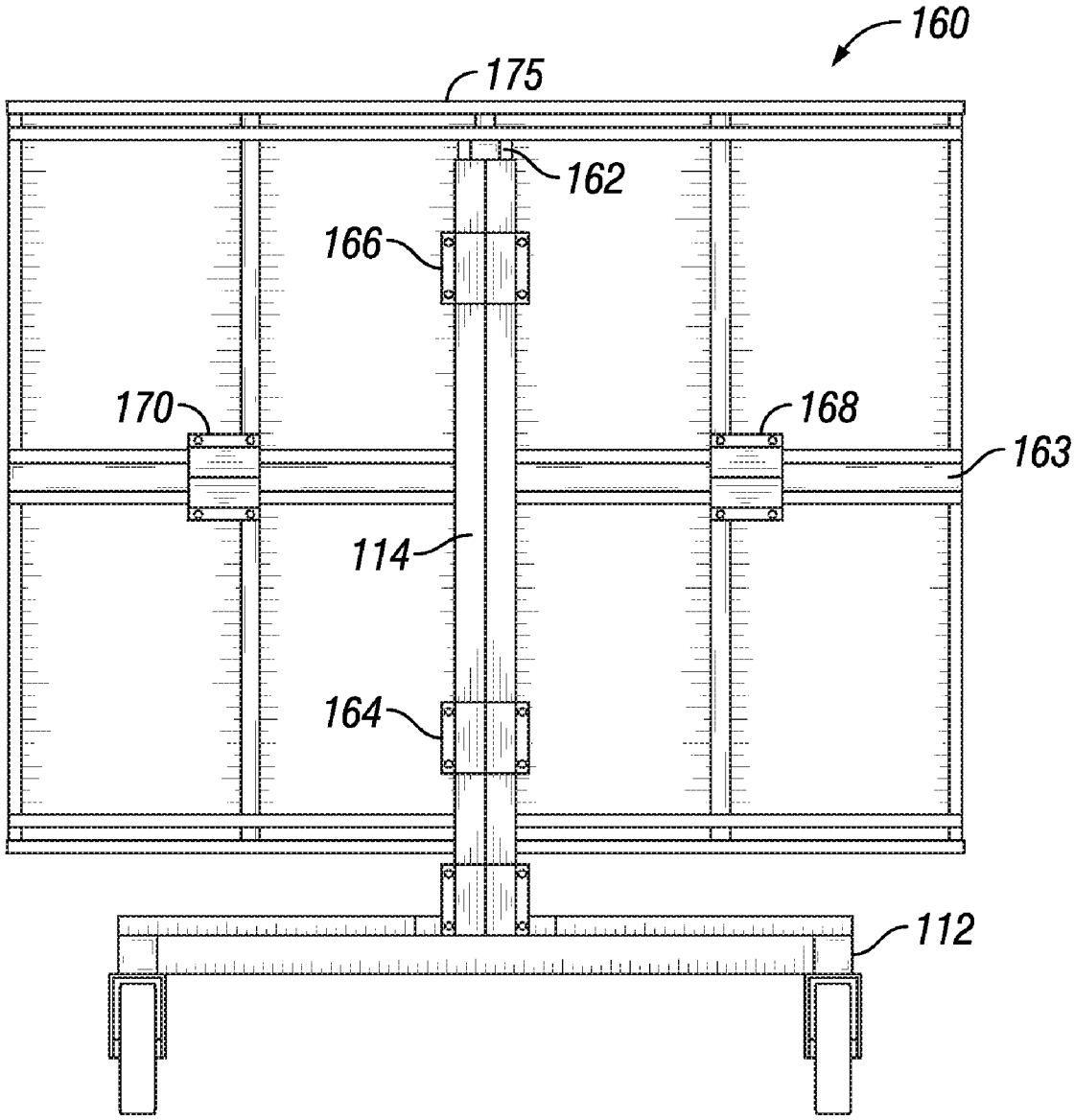

Referring now also to FIGS. 6A and 6B, rear views of a frame 160 for another embodiment of the portable projectile trap assembly 100 are shown. The construction of frame 160 is similar to the construction of frame 122 as described above with reference to FIGS. 4 and 5. The frame 160 is generally rectangular in shape having a number of parallel support members 132, 136 with side rails 172, 174, 175, 176 fastened across each side of the frame 160, respectively, and a number of intermediate rails 142, 146 fastened on a front side of and perpendicular to the support members 132, 136. A center support member 161 has a short member 162 positioned perpendicular to a long member 163, one member crossing the other at each member's center point to form a generally cross-shaped structure. The center support 161 is fastened, by welding or bolting, for example, to the rear side of the frame 160. The short member 162 is aligned along the centerline or axis of the shorter dimension of the frame 160, while the long member 163 is aligned along the axis or centerline of the longer dimension of the frame 160. The two support members 162 and 163 are rigidly fastened together at each member's center point by bolting or welding, for example. Alternatively, the center support member may be an integral structure; for example, forged or milled from a single piece of material. The center support member 161 is made of suitable material, such as steel, for example, having sufficient strength to support the frame 160 and the backstop when assembled and positioned in a vertical orientation and when it is moved from one position to another.

Each center support member 162, 163 has a pair of brackets 164, 166 and 168, 170, respectively, fixedly attached thereto, the brackets being spaced apart near the ends of each center support member 162, 163. Thus, the center support short member 162 has a pair of brackets 164, 166 mounted thereon, a bracket near each end of the center support short member 162. Similarly, the center support long member 163 has a pair of brackets 168, 170 mounted thereon, a bracket near each end of the center support long member 163. As described above with reference to FIGS. 2 and 5, a support mast 114 can then be attached and clamped to the frame 160 using the pair of brackets 164, 166 along the center support short member 162. In a similar fashion, the support mast 114 may be attached and clamped to the frame 160 using the pair of brackets 168, 170 along the center support long member 163. When the lower end of the support mast 114 is attached to the mobile base 112, as described above with reference to FIG. 2, the frame 160 will be supported in a vertical orientation. Thus when the support mast 114 is attached to the center support short member 162 with the lower end of the support mast 114 attached to the base 112, the height of the target assembly, i.e., the upper or top edge 175 of the frame 160, as shown in FIG. 6*a*, will be lower than when the support mast 114 is attached to the center support long member 163 and to the base 112. It is desirable that the length of the support mast 114 be sufficient to also allow the height of the top edge 175 to be adjusted by by varying the position of the frame 122 on the support mast 114. Alternatively, support mast 114 may be telescoping thus providing a support mast 114 of varying length to allow the height of the top edge 175 to be adjusted as desired.

Figure 6C:
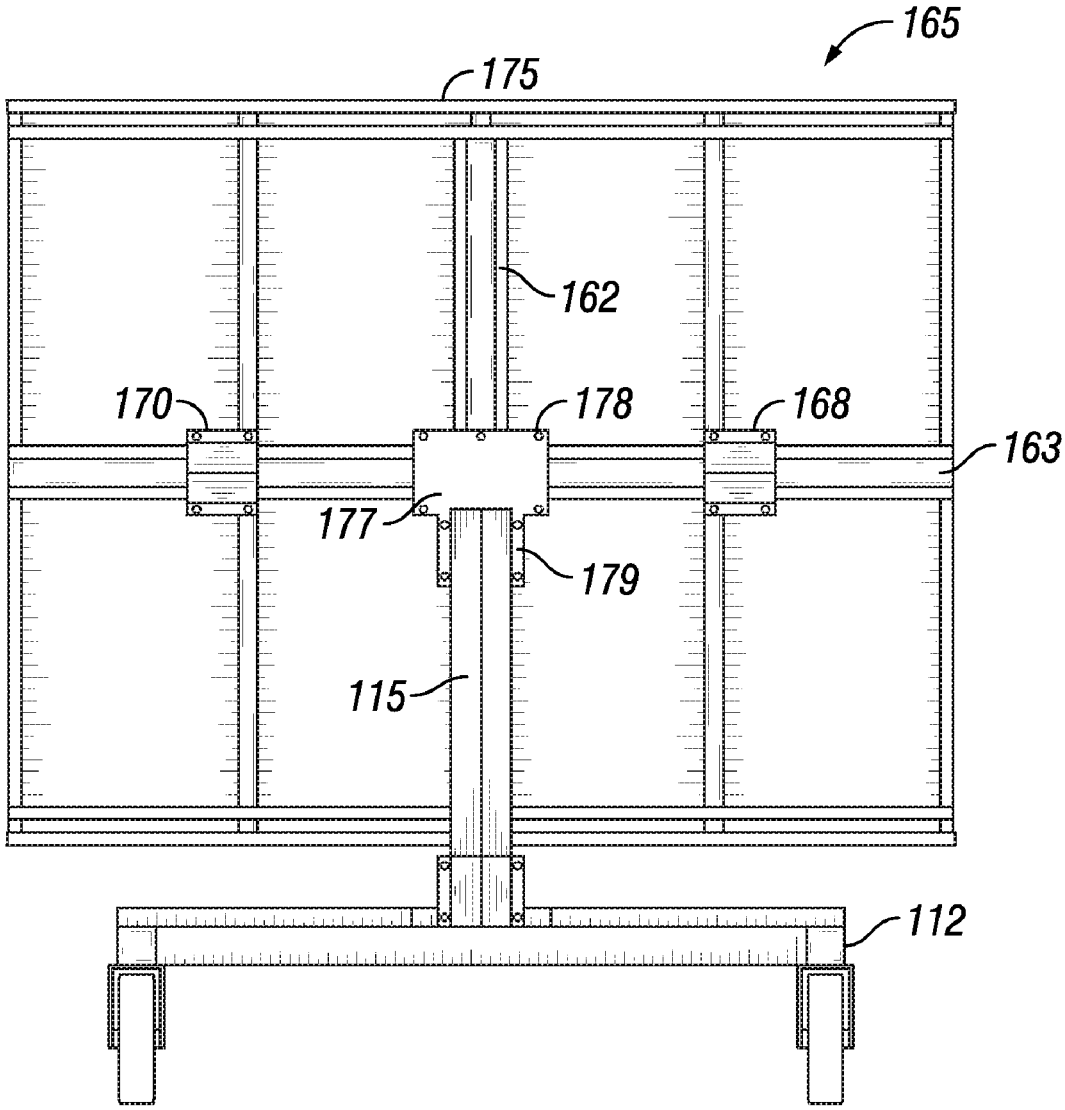
FIG. 6C is a rear view of another embodiment of the portable projectile trap assembly shown in FIGS. 6A and 6B.

Referring now also to FIG. 6C, a rear view of a frame 165 for another embodiment of the portable projectile trap assembly 100 of FIGS. 6A and 6B is shown. The construction of frame 165 is similar to the construction of frame 160 as described above with reference to FIGS. 6A and 6B. A center support member has a short member 162 positioned perpendicular to a long member 163, one member crossing the other at each member's center point to form a generally cross-shaped structure. The center support member is fastened, by welding or bolting, for example, to the rear side of the frame 165. The short member 162 is aligned along the centerline or axis of the shorter dimension of the frame 165, while the long member 163 is aligned along the axis or centerline of the longer dimension of the frame 165. The two support members 162 and 163 are rigidly fastened together at each member's center point by bolting or welding, for example. Alternatively, the center support member may be an integral structure; for example, forged or milled from a single piece of material. The center support member is made of suitable material, such as steel, for example, having sufficient strength to support the frame 165 and the backstop when assembled and positioned in a vertical orientation and when it is moved from one position to another. The center support long member 163 has a pair of brackets 168, 170 mounted thereon, a bracket near each end of the center support long member 163. The center support short member 162 has a single central bracket 178 mounted thereon at the center point of the short member 162; i.e., at the point where the short member 162 crosses the long member 163. The central bracket 178 is essentially a T-bracket having one bore 177 of the bracket parallel to and aligned with the axis of the long member 163 and having the other bore 179 of the bracket parallel to and aligned with the axis of the short member 162. Similar to brackets 168, 170, the central bracket 178 preferably comprises a two-piece clamp-type bracket forming an interior shape when the two pieces are bolted or otherwise fastened together similar to the exterior shape of the support mast 114. When the support mast 114 is attached to the center support long member 163, as shown in FIG. 2, it will be disposed in the central bracket bore 177 and all three brackets 168, 170 and 178 will be used to fixedly attach the mast to the center support long member 163. The bore 179 aligned with the short member 162 forms a female receiver for receiving one end of a support mast 115 and fixedly attaching it to the short member 162.

When the support mast 114 is attached to the center support long member 163 with its lower end attached to the base 112, the target assembly 110 will be supported in a vertical position, as shown in FIG. 2. The support mast 115, as shown in FIG. 6C, is significantly shorter than the support mast 114, the length of support mast 115 being about half the short dimension of the short member 162 plus sufficient length to facilitate attachment of the mast 115 to the base 112. When the support mast 115 is received by the central bracket bore 179 and attached to the base 112, the target assembly 110 will also be supported in a vertical orientation. However, due to the length of the support mast 115, the height of the target assembly, i.e., the upper or top edge 175 of the frame 165, as shown in FIG. 6C, will be lower than the top edge 111 of the target assembly 110, as shown in FIG. 2, when the support mast 114 is attached to the center support long member 163 and to the base 112. The support mast 115 may be telescoping thus providing a support mast 115 of varying length to allow the height of the top edge 175 to be adjusted as desired.

Referring now also to FIGS. 7-11, FIG. 7 shows a side view of the frame 122 of FIG. 3. As described above with reference to FIG. 3, the frame 122 is generally square or rectangular in shape having a number of parallel support members 132, 134, 136. Only support member 136 is shown in FIG. 7, with top and bottom rails 138, 140 attached across the top and bottom, respectively, on a front side of and perpendicular to the support members 132, 134, 136. Intermediate rails 142, 144, 146 are spaced between the top and bottom rails 138, 140, positioned perpendicularly to and fastened to support members 132, 134, 136 on a front side of the support members 132, 134, 136. The spacing between the top and bottom rails 138, 140 and the intermediate rails 142, 144, 146, respectively, is generally selected to accommodate the width or shorter dimension of the backstop panels 124. The top rail 138 has a track or runner 182 formed integrally with the top rail and runs the length of the top rail 138. The top rail 138 also includes a channel 180 formed along the edge of the top rail 138 facing away from the frame 122 and runs the along the length of the top rail 138. The channel 180 is spaced from the track 182 a sufficient amount to allow an air space or gap 188 to be formed between the backstop panels 124 and the resilient panel 120 when the backstop is assembled. In one embodiment, the air space or gap 188 is about one inch, for example.

As shown in FIG. 10, the bottom rail 140 is similar in construction to the top rail 138. The bottom rail 140 has a track or runner 182 formed integrally with the bottom rail 140 and runs the length of the bottom rail 140. The bottom rail 140 includes a channel 184 formed along the edge of the bottom rail 140 facing away from the frame 122 and runs the along the length of the bottom rail 140. The channel 184 is spaced from the track 182 sufficiently to allow an air space or gap 188 to be formed between the backstop panels 124 and the resilient panel 120 when the backstop is assembled. The bottom rail 140 is constructed to provide an open space or gap 186 between the track 182 and the channel 184; the gap 186 is preferably the same width as the width of the gap 188 formed between the backstop panels 124 and the front panel 120. As described above, the gap 186 allows projectile fragments and other debris to fall through the bottom of the target assembly 110 into a tray 113 for collection and later disposal.

Each of the intermediate rails 142, 144, 146 has a track or runner 182 formed on both the top and bottom sides of the front edge of the rail. The tracks 182 are spaced from the front side of the frame 122 and aligned with the tracks 182 of both the top and bottom rails 138, 140. The backstop panels 124 are of generally rectangular shape, such as fourteen and one-half inches wide by twenty-three and three-quarters inches long, for example. In one embodiment, the backstop panels are about one-half inch thick, but may be of any thickness sufficient for a particular application. As shown in FIGS. 8 and 9, in one embodiment, the backstop panels 124 have a groove 181 formed in opposing edges along the length of the backstop panel. The dimensions of the groove 181 are slightly larger than the dimensions of the track or runner 182 formed in the top, bottom and intermediate rails 138, 140, 142, 144, 146 to allow the backstop panels 124 to slideably engage and be retained between the rails by the tracks 182.

Figure 11:
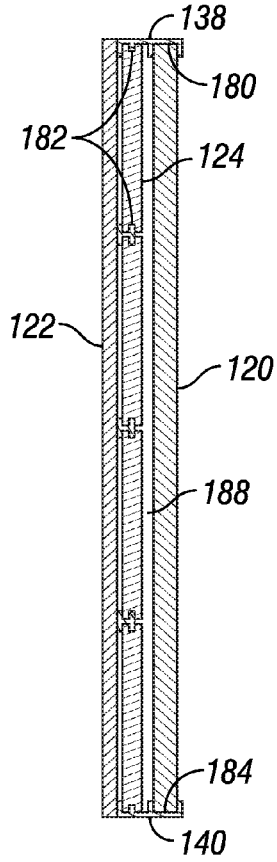
FIG. 11 is a side view of an embodiment of an assembled target assembly of the portable projectile trap assembly shown in FIG. 1.

As discussed above, the projectile trap assembly 100 may be shipped as a modular kit or package. In some embodiments, to assemble the projectile trap assembly 100, the base assembly 112 is placed with all four wheels 116 on a level surface. The support mast 114 is set in the base bracket 128, and the support mast 114 is securely fastened to the base assembly 112. In a vertical orientation, the frame 122 is rested on the base assembly, the back side of the frame 122 being adjacent the support mast 114. The frame 122 is loosely attached to the support mast 114 using the lower bracket 126. Then the frame 122 is slid up the support mast 114 to a desired height, and the lower bracket 126 is tightened securely fastening the frame 122 to the support mast 114. The upper bracket 127 is attached and tightened to complete attaching the frame 122 to the support mast 114. With the frame 122 being held in a vertical position by the support mast 114, the backstop panels 124 are slid into the frame between the rails 138, 140, 142, 144, 146, the grooves 181 engaging the tracks 182. The backstop panels 124 are inserted from either side of the frame 122. The backstop panels 124 are inserted completely into the frame 122, abutting each other. The front panel 120 is then positioned in the frame 122, by inserting the top and bottom edges of the front panel 120 into the channels 180 and 184 in the top and bottom rails 138 and 140, respectively, sliding the front panel 120 the length of the channels 180, 184, as shown in FIG. 11. To complete the assembly of the target assembly 110, the end caps 148, 150 are attached to each side of the assembly 110, respectively, and securely fastened to the frame 122 to retain the backstop panels 124 and the front panel 120 in place. Prior to use, a tray 113 is placed on the base assembly 112 under the target assembly 110 to collect projectile fragments and other debris that drops through the gap 186 formed in the bottom rail 140. Alternatively, the tray 113 may be attached to the target assembly 110 below the bottom rail 140.

Although the present disclosure has been described in terms of certain embodiments, other embodiments that are apparent to those of ordinary skill in the art, including embodiments which do not provide all of the features and advantages set forth herein, are also within the scope of this disclosure. Accordingly, the scope of the present disclosure is defined by the claims that follow.

What is claimed is:

1. A projectile trap assembly, comprising:

a frame configured to retain a plurality of backstop panels;

a plurality of backstop panels mounted in the frame forming a planar backstop;

a panel of resilient material covering the planar backstop, the panel of resilient material being spaced from the planar backstop; and a mobile base, the frame disposed in a vertical orientation and attached at a rear side of the frame to the mobile base;

wherein the frame comprises at least two mounting brackets attached along a centerline to the rear side of the frame, the mounting brackets removably attaching the frame to a support mast attached to the mobile base.

2. The assembly of claim 1, wherein the backstop panels are formed of abrasion resistant steel plate.

3. The assembly of claim 1, wherein the panel of resilient material comprises vulcanized rubber.

4. A projectile trap assembly comprising:

a modular target assembly, the modular target assembly comprising:

a frame configured to retain a plurality of backstop panels;

a plurality of backstop panels removably mounted on a front side of the frame forming a planar backstop; and a panel of resilient material removably mounted to and covering the side of the planar backstop opposite the frame, the panel of resilient material being spaced from the planar backstop; and a mobile base, the modular target assembly disposed in a vertical orientation and attached at a rear side of the frame to the mobile base;

wherein the frame is bounded by a top edge, a bottom edge opposite the top edge, and two opposing side edges, the top edge and the bottom edge comprising a top mounting rail and a bottom mounting rail, each of the top mounting rail and the bottom mounting rail including a track running the length of the mounting rail and a channel spaced from and parallel to the track.

5. The assembly of claim 4, wherein the frame comprises a plurality of spaced intermediate mounting rails disposed parallel to the top edge and the bottom edge, each of the intermediate mounting rails having a track formed on each side of the rail at an edge of the rail opposite the frame, the track running the length of the rail, the tracks formed on the top rail, the bottom rail and the spaced intermediate rails being aligned with one another.

6. The assembly of claim 5 wherein each of the plurality of backstop panels includes a pair of grooves for slideably engaging a mounting rail track, a groove being formed in each of two opposing edges of a backstop panel, the plurality of backstop panels being slideably mounted and retained between the spaced intermediate mounting rails and the top and bottom mounting rails.

7. The assembly of claim 4, wherein the panel of resilient material is slideably received and retained by the channel formed in the top and bottom mounting rails.

8. The assembly of claim 4, wherein the bottom mounting rail includes an open gap formed between the track and the channel, the gap running the length of the bottom rail.

9. The assembly of claim 4, wherein the backstop panels are formed of abrasion resistant steel plate.

10. The assembly of claim 4, wherein the panel of resilient material comprises vulcanized rubber.

11. A projectile trap assembly, comprising:

a frame configured to retain a plurality of backstop panels;

a plurality of backstop panels mounted in the frame forming a planar backstop; and a panel of resilient material covering the planar backstop, the panel of resilient material being spaced from the planar backstop;

wherein the planar frame is bounded by a top edge, a bottom edge opposite the top edge, and two opposing side edges, the top edge and the bottom edge comprising a top mounting rail and a bottom mounting rail, each of the top mounting rail and the bottom mounting rail including a track running the length of the mounting rail and a channel spaced from and parallel to the track.

12. The assembly of claim 11, further comprising a mobile base, the frame disposed in a vertical orientation and attached at a rear side of the frame to the mobile base.

13. The assembly of claim 11, wherein the bottom mounting rail includes an open gap formed between the track and the channel, the gap running the length of the bottom rail.

14. The assembly of claim 11, wherein the frame comprises a plurality of spaced intermediate mounting rails disposed parallel to the top edge and the bottom edge, each of the intermediate mounting rails having a track formed on each side of the rail at an edge of the rail opposite the frame, the track running the length of the rail, the tracks formed on the top rail, the bottom rail and the spaced intermediate rails being aligned with one another.

15. The assembly of claim 14 wherein each of the plurality of backstop panels includes a pair of grooves for slideably engaging a mounting rail track, a groove being formed in each of two opposing edges of the backstop panel, the plurality of backstop panels being slideably mounted and retained between the spaced intermediate mounting rails and the top and bottom mounting rails.

16. The assembly of claim 11, wherein the panel of resilient material is slideably received and retained by the channel formed in the top and bottom mounting rails.

17. A method of assembling a projectile trap assembly comprising the steps of:

attaching a support mast to a base, the support mast disposed in a vertical orientation;

attaching a frame to the support mast at a rear side of the frame, the frame configured to retain a plurality of backstop panels;

mounting a plurality of backstop panels on a front side of the frame forming a planar backstop; and mounting a panel of resilient material to the front side of the frame, the panel of resilient material covering a side of the planar backstop opposite the frame, the panel of resilient material being spaced from the planar backstop;

wherein the frame is bounded by a top edge, a bottom edge opposite the top edge, and two opposing side edges, the top edge and the bottom edge comprising a top mounting rail and a bottom mounting rail, each of the top mounting rail and the bottom mounting rail including a track running the length of the mounting rail and a channel spaced from and parallel to the track, and a plurality of spaced intermediate mounting rails disposed between and parallel to the top edge and the bottom edge, each of the intermediate mounting rails having a track formed on each side of the rail at an edge of the rail opposite the frame, the track running the length of the rail, the tracks formed on the top rail, the bottom rail and the spaced intermediate rails being aligned with one another.

18. The method of claim 17, wherein the position of the frame on the support mast being slideably adjustable, the frame being fixedly attached at a desired position on the support mast.

19. The method of claim 17, wherein the base comprises a mobile base.

20. The method of claim 17, wherein the step of mounting a plurality of backstop panels on a front side of the frame comprises inserting the plurality of backstop panels between adjacent ones of the top and bottom mounting rails and the intermediate mounting rails, the backstop panels being adapted to slideably engage the tracks formed on the top rail, the bottom rail and the spaced intermediate rails.

21. The method of claim 20, wherein the step of mounting a panel of resilient material to the front side of the frame comprises inserting the panel of resilient material between the top and bottom mounting rails, a top edge and bottom edge of the resilient panel slideably engaging the channel formed in each of the top and bottom mounting rails, respectively.

* * * * *